US007476141B2

(12) United States Patent
Hom

(10) Patent No.: US 7,476,141 B2
(45) Date of Patent: Jan. 13, 2009

(54) TOY BALLOON SABER

(76) Inventor: Young Jesse Hom, 17820 Alburtis Ace #11, Artesia, CA (US) 90701

( * ) Notice: Subject to any disclaimer, the term of this patent is extended or adjusted under 35 U.S.C. 154(b) by 363 days.

(21) Appl. No.: 11/509,430

(22) Filed: Aug. 25, 2006

(65) Prior Publication Data

US 2008/0051003 A1 Feb. 28, 2008

(51) Int. Cl.
*A63H 3/06* (2006.01)

(52) U.S. Cl. ..... 446/220; 446/485; 446/219; 446/473; 362/96; 362/109; 362/253

(58) Field of Classification Search ..... 446/220, 446/473, 219, 485; 362/96, 109, 253
See application file for complete search history.

(56) References Cited

U.S. PATENT DOCUMENTS 2,669,062 A * 2/1954 Baggott ..... 446/220
3,807,904 A * 4/1974 Schuman ..... 417/207
4,080,751 A * 3/1978 Copstead ..... 446/220
4,678,450 A * 7/1987 Scolari et al. ..... 446/473
5,127,871 A * 7/1992 Miller ..... 446/473
5,295,926 A * 3/1994 Tanabe ..... 482/12
5,389,033 A * 2/1995 Rauch ..... 446/473
5,947,789 A * 9/1999 Chan ..... 446/219
6,010,435 A * 1/2000 Tanabe ..... 482/83
6,036,602 A * 3/2000 Abbott ..... 482/12
6,337,946 B1 * 1/2002 McGaffigan ..... 362/559
6,575,837 B1 * 6/2003 Weske et al. ..... 482/12
7,033,242 B2 * 4/2006 Gulmesoff ..... 446/473

* cited by examiner

*Primary Examiner*—Gene Kim
*Assistant Examiner*—Urszula M Cegielnik
(74) *Attorney, Agent, or Firm*—Park Law Firm; John K. Park

(57) ABSTRACT

A toy balloon saber is provided. The toy balloon saber equipped with a lightening means according to the current application is comprised of a blade part that is comprised of an elastic plastic balloon, a handle part that is comprised of a hand pump, which also works as a flash light. The balloon blade is in a contracted state when not in use. When a user want to use the toy balloon saber, air is pumped into the balloon to tighten the balloon and make it stiff. The flash light is turned on when the saber is used. An air outlet is open when the blade is to be contracted. Another embodiment of the current invention is a toy balloon saber without any lightening means.

2 Claims, 5 Drawing Sheets

TOY BALLOON SABER

FIELD OF THE INVENTION

Current application is related with a toy balloon saber, especially related with a toy balloon saber equipped with a lightening means that can be inflated by an air pump and contracted by an air outlet.

BACKGROUND OF THE INVENTION

'Star Wars' is a legend in movie history of scientific fiction field. Many kind of props and characters are created for the movie. Copy of the props and miniatures of the characters were great success in toy market. Passion for them sustains even after the 'Star Wars' series is ended. Among them the most 'want-to-have' item for the kids and young men is the 'Light Saber.' Most fascinating part of the 'Light Saber' is that the light blade disappears when it is not used. That is totally new concept for a sword or saber. Realization of the real 'Light Saber' is impossible yet though the progress in laser technology enabled a laser gun to shoot down a missile and an energy shield on a restricted area. Meanwhile, many kind of toys are introduced in the market that insists a mimic of the 'Light Saber.' One of them is a fluorescent lamp attached on a handle that is a battery case. But, that is use-less as a toy because it is dangerous for the glass bulb that constitutes the blade body. It is purpose of the current invention to provide a safe toy 'Light Saber' that contracted and expanded safely and emits light when in use.

DESCRIPTION OF THE PRIOR ART

U.S. Pat. No. 7,033,242 to Gulmesoff illustrates a toy sword having at least one visual or auditory indicator for signaling a user when the sword contacts a target is provided. It is a kind of fencing point indicator.

U.S. Pat. No. 6,036,602 to Abbott discloses a sparring instrument which allows for safe, pain free, full contact training. The sparring instrument comprises a handle and a striking portion covered with a bushing armature. The bushing armature is again covered by a sheath extending beyond the tip rod. The sheath is made of a soft, resilient material whereby the sheath extends from the end of the soft, flexible material when the instrument is bent. It is a solid training sword covered with soft bushing and cover.

U.S. Pat. Nos. 6,010,435 and 5,295,926 to Tanabe illustrates a bag-shaped sword blade section having a throttled opening formed of a sealing and elastic material such as rubber is fitted onto and closely attached to a tip end of a cylindrical-shaped grip formed of a hard material such as wood, a hard rubber, plastics and metals. A gas such as air is filled in the sword blade section to define a cavity. All his illustrations are balloon sword with a stick.

U.S. Pat. No. 5,947,789 to Chan illustrates a toy sword featuring a handle section housing a light source for illuminating an interior of the blade section and a translucent blade section. It is blinking solid plastic sword.

U.S. Pat. No. 5,389,033 to Rauch illustrates a toy sword assembly that includes an elongated blade and handles subpart and a guard part that fits on a guard grasping section of the blade and handles subpart. It is like hard board paper toy sword.

U.S. Pat. No. 5,127,871 to Miller illustrates a flexible foam sword which includes a one-piece sword piece and a guard piece. It is like a sword made of Styrofoam plate.

U.S. Pat. No. 4,678,450 to Scolari, et al. illustrates a toy light sword including a hollow blade with a fluorescent coating on the inside or translucent and tends to glow when illuminated. It is similar to light saber of Star Wars. But the sword does not contract.

U.S. Pat. No. 4,080,751 to Copstead illustrates a toy sword having a resilient, air-inflatable blade. Means are also provided for securing a rigid handle to the resilient blade. It is inflatable balloon sword but no light is provided.

U.S. Pat. Nos. 3,807,904 and RE30,894 to Schuman illustrate a substantially closed cylinder containing a compressible air or liquid. The passageways are heated along their lengths by an electric bulb which provides sufficient heat energy for sustaining said oscillation while providing light for illumination of the surroundings. But the light is installed over a head of cylinder. It has no relation with the piston.

None of the prior art introduces a toy 'Light Saber' that is safe to use while contracting, expanding and lighting at the same time.

SUMMARY OF THE INVENTION

'Star Wars' is a legend in movie history of scientific fiction field. Many kind of props and characters are created for the movie. Copy of the props and miniatures of the characters were great success in toy market. Among them the most 'want-to-have' item for the kids and young men is the 'Light Saber.' Most fascinating part of the 'Light Saber' is that the light blade disappears when it is not used. That is totally new concept for a sword or saber. Realization of the real 'Light Saber' is impossible yet. It is purpose of the current invention to provide a safe toy 'Light Saber' that contracted and expanded safely and emits light when in use. A toy light saber, equipped with a lightening means, according to the current application is comprised of a blade part that is comprised of an elastic plastic balloon, a handle part that is comprised of a hand pump, and a flash light that is installed between the blade part and the handle part. The balloon blade is in a contracted state when not in use. When a user want to use the toy light saber, air is pumped into the balloon to tighten the balloon and make it stiff. The flash light is turned on when the saber is used. The light from the flash illuminates the balloon from inside and gives an impression of a light saber. Air is released from the balloon by disengaging a flip clamp that is used to hold the balloon. The balloon blade is stored inside of a flash light head after air is released and the balloon is contracted. Another embodiment of the current application is a toy balloon that does not have light source there within. Only hand air pump and balloon blade are connected.

DETAILED DESCRIPTION OF THE PREFERRED EMBODIMENT

Figure 1:
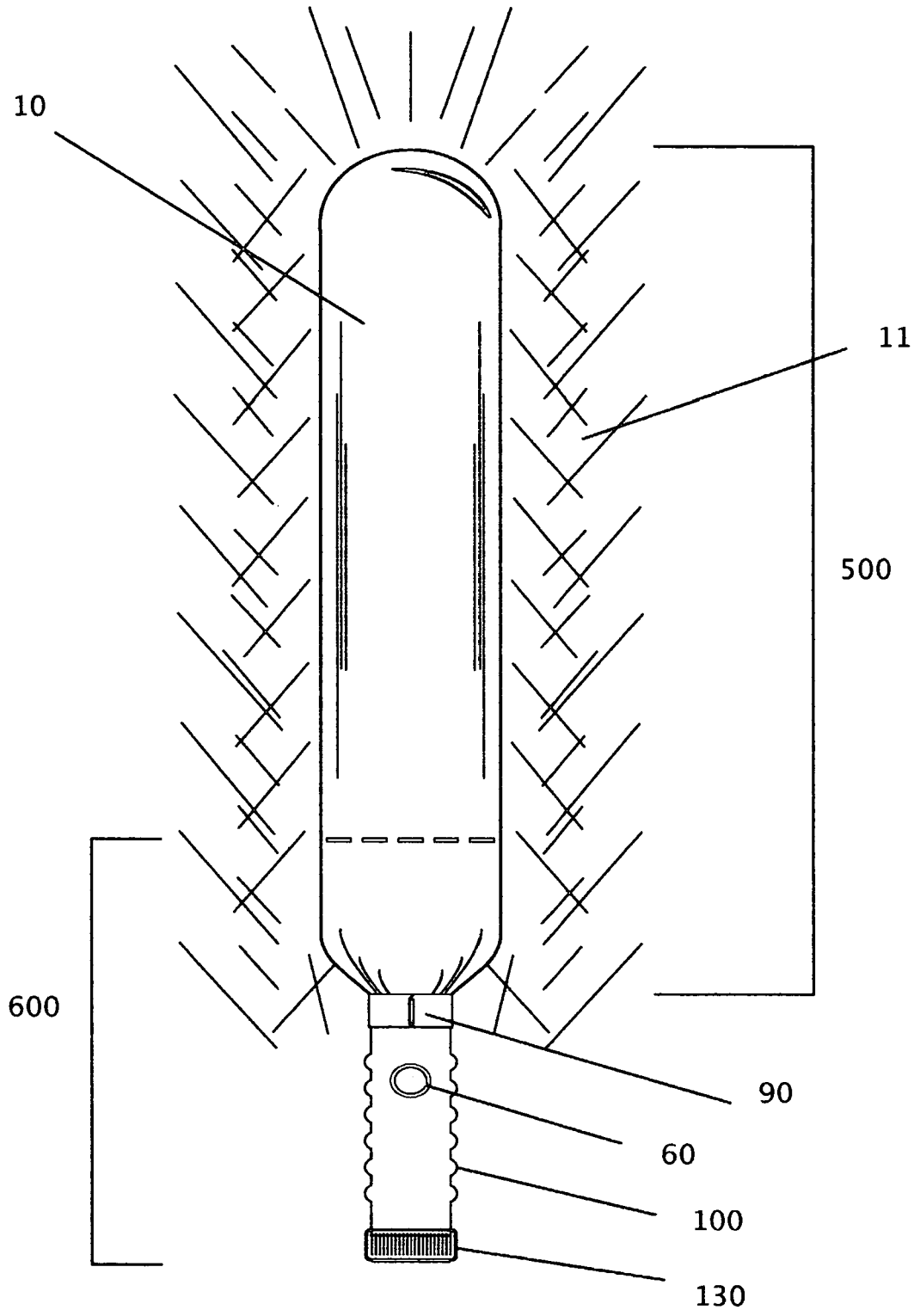
FIG. 1 is a front view of a toy balloon saber with lightening means according to current application.

FIG. 1 is a front view of a toy balloon saber (11) equipped with a lightening means according to the current application. The toy balloon saber (11) equipped with a lightening means is comprised of a blade part (500) and a handle part (600), which are connected by a connector (40) and a clamp (90). The blade part (500) is comprised of a flexible plastic balloon (10), such as flexible PVC (Poly Vinyl Chloride). Thickness of the balloon's skin is controlled between 0.3 mm to 1.0 mm. Then the flexibility of the blade balloon (10) is similar to that of a kid's swimming tube. The balloon (10) is clearly transparent or semi transparent with a color such as red, blue, green or indigo. Upper end (10-U) of the balloon (10) is sealed with hemi-sphere shape to avoid user's hurt while playing. Lower end (10-L) of the balloon (10) is straight and open.

Figure 2:
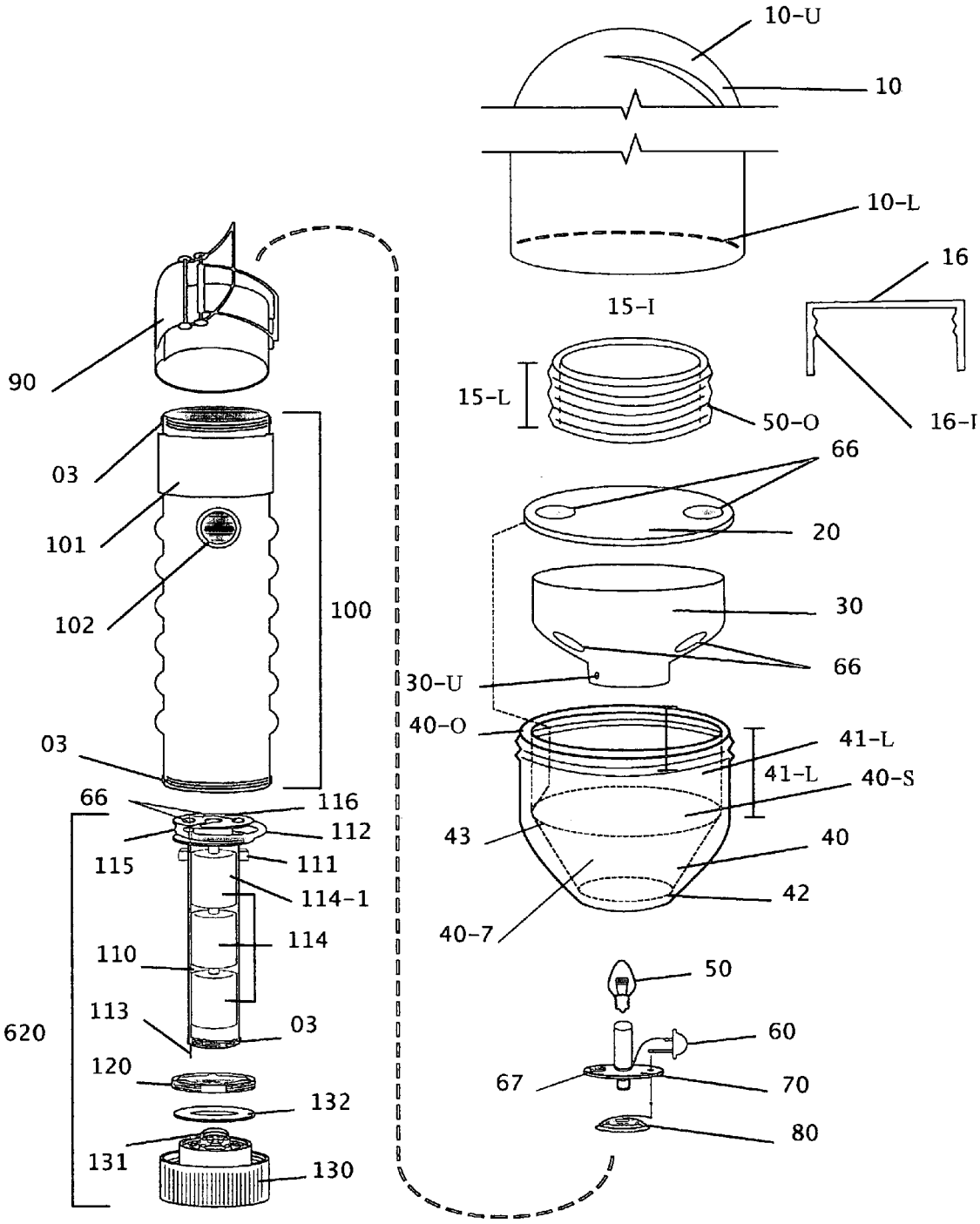
FIG. 2 is an exploded view of the toy balloon saber with lightening means according to current application.

FIG. 2 is an exploded view of the toy balloon saber (11) equipped with a lightening means according to current application. The straight open lower end (10-L) of the balloon (10) reaches to the clamping area (101), which locates at the upper part of the pump cylinder (100) and held by a clamp (90). The clamp (90) is a flip clamp that engages and disengages by one touch. The handle part (600) is a combination of flash light and hand air pump. The flash light part is comprised of a lamp head cap (15), a lamp head cap cover (16), a lens (20) that has two air inlet holes (66-1), a reflector (30) that has another two air inlet holes (66-2), a lamp head (40), a light bulb (50), a connection switch (60), a socket (70) that has air inlet valve (67), a contact coil (80), a (+) connector (115), a (−) connector (116), a (−) contact strip (113), three batteries (114), and battery case (110). The lamp head cap (15) is a straight pipe with a length (15-L) equivalent to the length (41-L) of the straight portion of the lamp head (40). Male screw (15-O) is developed out side of the lamp head cap (15). Female screw (40-I) is developed inside of the lamp head (40) to receive the male screw (15-O) on the out side of the lamp head cap (15). The lens (20) and the reflector (30) are inserted between the lamp head cap (15) and the lamp head (40). By turning the lamp head cap (15) to the clock wise, the lens (20) is pushed down to the boarder line (43) of the tapered section (40-T) and straight section (40-S) of the lamp head (40). The reflector (30) is inserted into the tapered section (40-T) of the lamp head (40). Then the straight bottom (30-U) of the reflector (30) comes out through open bottom of the lamp head (40) to contact with the socket (70) and press the contact spring coil (80). Connection between the socket (70) and the spring coil is controlled by the connection switch (60). The spring coil (80) contacts with the (+) connector (115) and (−) connector (116). Those connectors (115) and (116) are connected to the batteries (114) and the contact strip (113). The batteries (114) are contained in the battery case (110). The battery case (110) works as piston of air pump.

The inner space (15-I) of the lamp head cap (15) is reserved to receive the balloon (10) when it is retracted, air is out. Then, cover the cap (15) with a lamp head cap cover (16). Female screw (16-I), developed inside of the lamp head cap cover (16), is engaged to male screw (40-O) that is developed along the upper, out side of the lamp head (40).

Female screw (42), developed at the inside of the lower end of the lamp head (40) is engaged to the male screw (3-U) developed at the outside of the upper end of the pump cylinder (100). The pump cylinder (100) practically works as handle of the toy light saber (11) of the current application.

The pump part is comprised of a pump cylinder (100), a battery case (110) (that actually works as a pump piston), an O-ring (112), a shaft retainer ring (120), a shaft retainer ring key (111) that is developed upper out side of the battery case (110), a seal washer (132), a closing cap (130), and a contact spring (131).

Major part of the pump part is the pump cylinder (100) and the piston (which is named as a battery case (110) because batteries are contained therein). Two male screws are developed at the upper end and lower end of the pump cylinder (100). One male screw (3-U) locates at the upper end receives the female screw (42) that is developed at the inside of the lower end of the light head (40). Another male screw (3-L) locates at the lower end of the pump cylinder (100) is engaged to a female screw (130-I) which is developed inside of the closing cap (130) of the pump cylinder (100).

The toy balloon saber (11) equipped with a lightening means is provided to an user with the lamp head cap (15), the lens (20), the reflector (30), the lamp head (40), the light bulb (50), the socket (70), the connection switch (60), and the contact coil (80) as in an assembled state in one lamp head set. The balloon (10) is stored in the inner space (15-I) of the lamp head cap (15) and covered with the lamp head cap cover (16).

The battery case (110), the O-ring (112), the shaft retainer ring (120), the shaft retainer ring key (111), the seal washer (132), and the contact spring (131) are assembled in the pump cylinder (100) and a blocked with the closing cap (130).

The lamp head set and the pump part are connected via the female screw (42) developed at the inside of the lower end of the lamp head (40) and the male screw (3-U) developed at the outside of the upper end of the pump cylinder (100).

When a user try to use the toy light saber (11), open the lamp head cap cover (16) and take out the balloon (10).

Insert the pump set into the open end (10-L) of the balloon until the open end (10-L) reaches the upper part (101) of the pump cylinder (100). Engage the clamp (90) over the balloon (10) and close it.

Open the closing cap (130) of the pump cylinder (100). Draw out the battery case (110) from the pump cylinder (100). Then the battery case (110) roles as a piston of the pump. Grasp the battery case (110) and push the case (110) into the pump cylinder (100). Then the air pass through the air inlet valve (67), two air inlet holes (66-2) developed on the reflector (30), two air inlet holes (66-1) developed on the lens (20), and injected in the balloon.

When the battery case (110) is pulled back, the air inlet valve (67) is closed. Then air is introduced to the space between the battery case (110) and the bottom of the socket (70) through the third air holes (67) which are developed on the plate of the (−) connector (116). Repeat push and pull the battery case (110) until the balloon is inflated tightly.

Insert batteries into the battery case and engage the closing cap (130) to the pump cylinder (100) and tighten the cap (130).

Press the connection switch (60). Then the balloon (10) flashes as shown in the FIG. 1. User now enjoys a crossing sword game with a balloon light saber.

After the game, turn off the connection switch and disengage the clamp (90). Then the air captured inside of the balloon (10) is released through the lower end (10-L) of the balloon quickly. Fold the balloon (10) and store it in the inner space (15-I) of the lamp head cap (15). And close the head cap with the lamp head cap cover (16).

Figure 3:
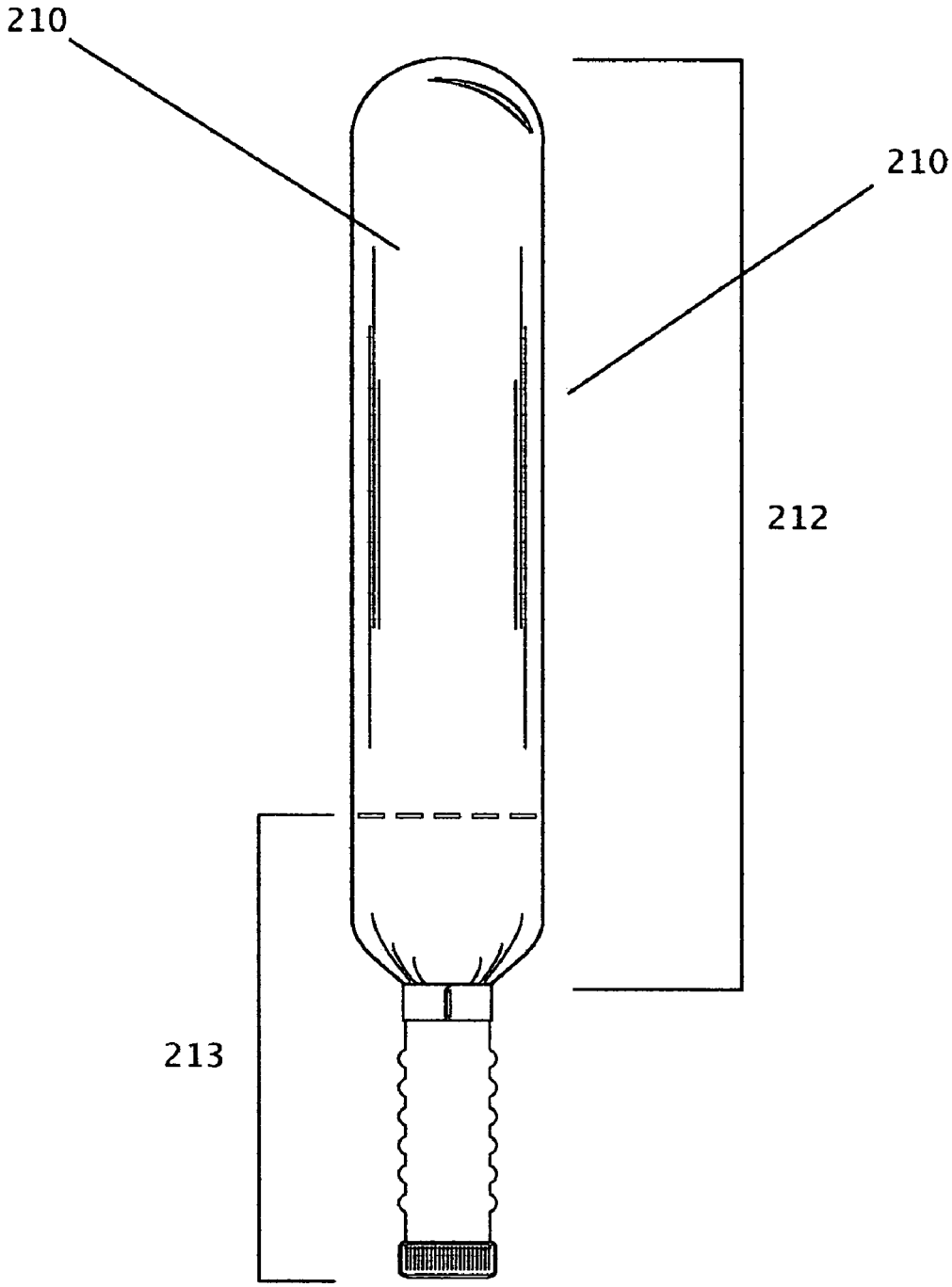
FIG. 3 is a rear view of the toy balloon saber according to another embodiment of the current application.

FIG. 3 is a front view of the toy balloon saber (211) according to another embodiment of the current application. The toy balloon saber (211) according to another embodiment of the current application is comprised of a blade part (212) and a handle part (213), which is comprised of a connector (240), a clamp (290), and an air pump (214). The blade part (211) is comprised of a flexible plastic balloon (210), such as flexible PVC (Poly Vinyl Chloride). Thickness of the balloon's skin is controlled between 0.3 mm to 1.0 mm. Then the flexibility of the blade balloon (210) is similar to that of a kid's swimming tube. The balloon (210) is clearly transparent or semi transparent with a color such as red, blue, green or indigo. Upper end (210-U) of the balloon (210) is sealed with hemi-sphere shape to avoid user's hurt while playing. Lower end (210-L) of the balloon (210) is straight and open.

Figure 4:
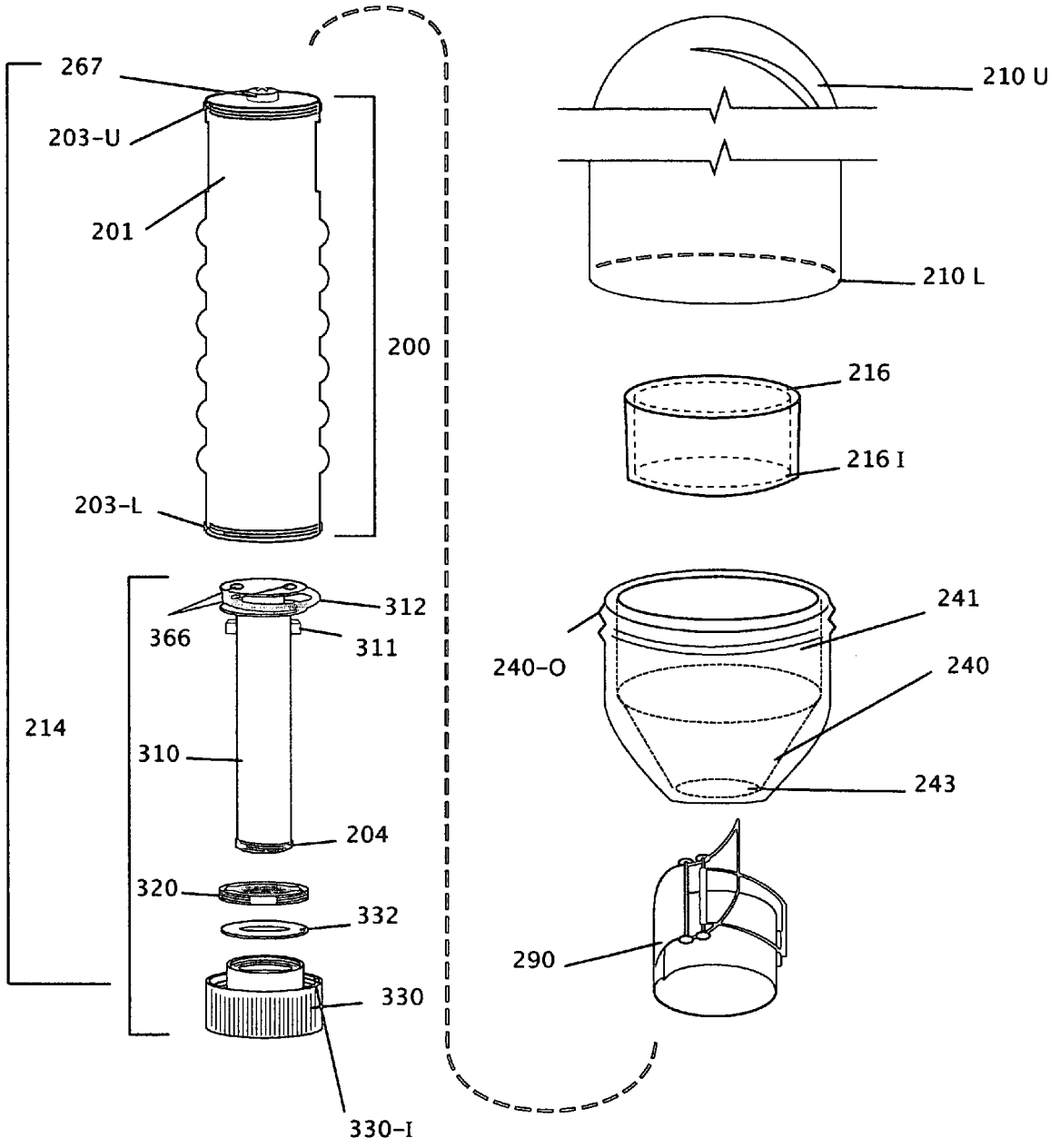
FIG. 4 is an exploded view of toy balloon saber according to another embodiment of the current application.
Figure 5:
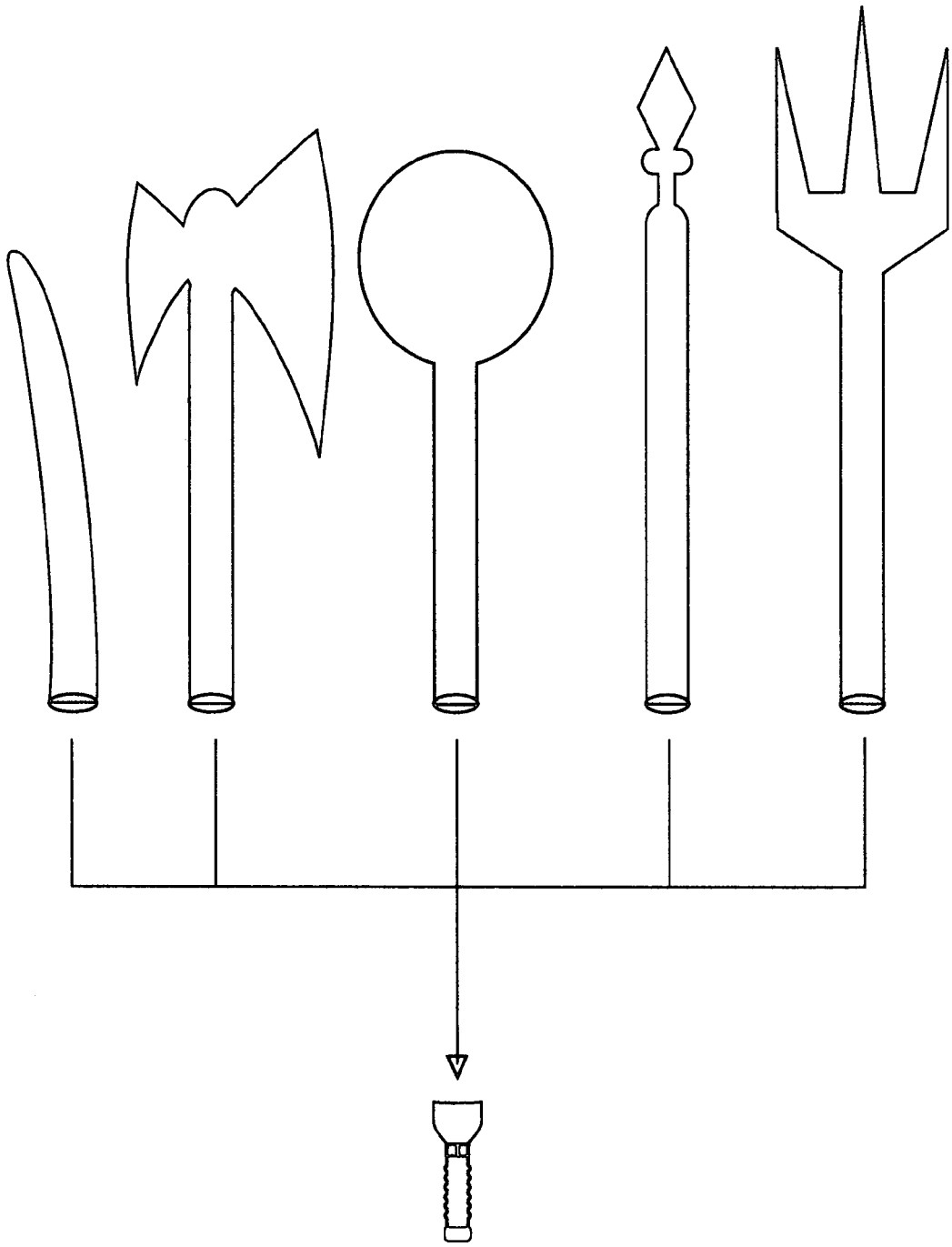
FIG. 5 is a schematic drawing of various type of blades that are inter-changeable with the blades of the toy light saber according to current application.

FIG. 4 is an exploded view of the toy balloon saber (211) according to another embodiment of the current application. The straight open lower end (210-L) of the balloon (210) reaches to the clamping area (201), which locates at the upper part of the pump cylinder (200) and held by a clamp (290). The clamp (290) is a flip clamp that engages and disengages by one touch.

The inner space (241) of a connector (240) is reserved to receive the balloon (210) when it is retracted, air is out. A connector cap cover (216) is used to cover the connector and hold the balloon therein. The cover (216) is engaged to the connector (240) via a female screw (216-I) developed inside of the lower end of the cover (216) and a male screw (240-O) developed on the out side of the upper end of the connector (240). Female screw (243), developed at the inside of the lower end of the connector (240) is engaged to the male screw (203-U) developed at the outside of the upper end of the pump cylinder (200). The pump cylinder (100) practically works as handle of the toy balloon saber (211) of another embodiment of the current application.

The air pump (214) is comprised of a pump cylinder (200), a pump piston (310), an O-ring (312), a shaft retainer ring (320), a shaft retainer ring key (311) that is developed upper out side of the piston (310), a seal washer (332), and a closing cap (330).

Two male screws are developed at the upper end lower end of the pump cylinder (200). One male screw (203-U) locates at the upper end receives the female screw (243) that is developed at the inside of the lower end of the connector (240). Another male screw (203-L) locates at the lower end of the pump cylinder (200) is engaged to a female screw (330-I) which is located inside of the closing cap (330) of the pump cylinder (200).

The toy balloon saber (211) kit is provided to a user with the connector (240) assembled to the pump cylinder (200). The balloon (210) is stored in the inner space (241) of the connector (240) and covered with the connector cover (216).

The piston (310), the O-ring (312), the shaft retainer ring (320), the shaft retainer ring key (311), and the seal washer (332) are assembled in the pump cylinder (200) and a blocked with the closing cap (330).

The connector (240) and the pump part (214) are connected via the female screw (243) developed at the inside of the lower end of the connector (240) And the male screw (203-U) developed at the outside of the upper end of the pump cylinder (200).

When a user try to use the toy balloon saber (211), open the connector cap cover (216) and take out the balloon (210).

Insert the pump set into the open end (210-L) of the balloon until the open end (210-L) reaches the upper part (201) of the pump cylinder (200). Engage the clamp (290) over the balloon (210) and close the clamp (290). Open the closing cap (230) of the pump cylinder (200). Draw out the piston (310) from the pump cylinder (200). Grasp the piston (310) and push the piston (310) into the pump cylinder (200). Then the air passes through the air inlet valve (267) and injected in the balloon.

When the piston (310) is pulled back, the air inlet valve (267) is closed. Then air is introduced to the space between the piston (310) and upper end of the cylinder (200) through the air holes (266) which are developed on a plate (312) that is attached on the upper end of the piston (310). Repeatedly push the piston (110) until the balloon (210) is inflated tightly. Then the toy balloon is inflated as shown in the FIG. 3.

After the game, disengage the clamp (290). Then the air captured inside of the balloon (210) is released through the lower end (210-L) of the balloon quickly. Fold the balloon (210) and store it in the inner space (241) of the connector (240). And close the connector (240) with the connector cap cover (216).

What is claimed is:

1. A toy balloon saber equipped with a lightening means is comprised of;

a blade part that is comprised of a flexible and transparent plastic balloon, upper end of which is sealed with hemi-sphere shape and lower end thereof is straight and open to reach to a clamping area that locates at upper part of a pump cylinder and held by a flip clamp, that is made of transparent flexible PVC (Poly Vinyl Chloride) of skin thickness 0.5 mm, and a handle part which is a combination of;

a flash light part, which is comprised of a lamp head cap, which is a straight pipe with a length equivalent to the length of the straight portion of a lamp head to receive the balloon when it is retracted and has a male screw developed out side of thereof to meet a female screw that is developed inside of a lamp head, and a lamp head cap cover, which covers the lamp head cap by engaging female screw, which is developed inside thereof, to a male screw that is developed along the upper, outside of a lamp head, and a lens that has two air inlet holes and is inserted between the lamp head cap and a lamp head, and a reflector that has another two air inlet holes and is inserted into a tapered section of a lamp head, and a lamp head, and a light bulb, and a connection switch, and a socket that has air inlet valve, and a contact coil, and a (+) connector, and a (−) connector, and a (−) contact strip, and three batteries, and a battery case, and a hand air pump that is comprised of a pump cylinder having two male screws, one of which locates at the upper end thereof receives the female screw that is developed at the inside of the lower end of the light head and another male screw locates at the lower end thereof is engaged to a female screw which is developed inside of a closing cap of the pump cylinder, and a battery case, and an O-ring, and a shaft retainer ring, and a shaft retainer ring key that is developed upper out side of the battery case, and a seal washer, and a closing cap, and a contact spring, and a flip connector that connects the blade part and the handle part.

2. A toy balloon saber equipped with a lightening means is comprised of;

a blade part that is comprised of a flexible and transparent plastic balloon, upper end of which is sealed with hemisphere shape and lower end thereof is straight and open to reach to a clamping area that locates at the upper part of a pump cylinder and held by a flip clamp, that is made of transparent flexible PVC (Poly Vinyl Chloride) of skin thickness 0.5 mm, and a handle part which is a combination of;

a connector cap, which is a straight pipe with a length equivalent to the length of the straight portion of a connector to receive the balloon when it is retracted and has a male screw developed out side of thereof to meet a female screw that is developed inside of a connector, and a connector cap cover, which covers the connector cap by engaging female screw, which is developed inside thereof, to a male screw that is developed along the upper, outside of a connector, and a connector, and a hand air pump that is comprised of a pump cylinder having two male screws, one of which locates at the upper end thereof receives the female screw that is developed at the inside of the lower end of the light head and another male screw locates at the lower end thereof is engaged to a female screw which is developed inside of a closing cap of the pump cylinder, and a pump shaft, and an O-ring, and a shaft retainer ring, and a shaft retainer ring key that is developed upper out side of the pump shaft, and a seal washer, and a closing cap, and a contact spring, and a flip connector, that connects the blade part and the handle part.

* * * * *